US006968590B2

(12) United States Patent
Ponzini

(10) Patent No.: US 6,968,590 B2
(45) Date of Patent: Nov. 29, 2005

(54) DISASSEMBLABLE TOOTHBRUSH WITH POSITIVE BLOCKING

(75) Inventor: Eligio Ponzini, Milan (IT)

(73) Assignee: Ponzini S.p.A., Lazzate (IT)

( * ) Notice: Subject to any disclaimer, the term of this patent is extended or adjusted under 35 U.S.C. 154(b) by 296 days.

(21) Appl. No.: 10/276,523

(22) PCT Filed: May 17, 2001

(86) PCT No.: PCT/IB01/00857

§ 371 (c)(1),
(2), (4) Date: Nov. 15, 2002

(87) PCT Pub. No.: WO01/87112

PCT Pub. Date: Nov. 22, 2001

(65) Prior Publication Data

US 2003/0115706 A1 Jun. 26, 2003

(30) Foreign Application Priority Data

May 18, 2000 (IT) ..... MI2000A1099

(51) Int. Cl.[7] ..... A46B 9/04

(52) U.S. Cl. ..... 15/167.1; 15/143.1; 15/145; 15/176.1; 15/176.6

(58) Field of Search ..... 15/167.1, 176.1, 15/176.3, 172, 143.1, 144.1, 145, 176.6; 403/329

(56) References Cited

U.S. PATENT DOCUMENTS

| | | | | | |
|---|---|---|---|---|---|
| 3,072,938 | A | * | 1/1963 | Phaneuf | 15/22.1 |
| 3,181,189 | A | * | 5/1965 | Leyden | 15/22.1 |
| 5,253,948 | A | * | 10/1993 | Butler | 403/289 |
| 5,339,482 | A | * | 8/1994 | Desimone et al. | 15/167.1 |
| 5,673,452 | A | | 10/1997 | Chang et al. | |
| 5,875,510 | A | | 3/1999 | Lamond et al. | |

FOREIGN PATENT DOCUMENTS

| | | |
|---|---|---|
| DE | 42 34 764 | 4/1994 |
| DE | 196 00 767 | 12/1996 |
| EP | 0 602 611 | 6/1994 |
| WO | WO 01/43583 | 6/2001 |

* cited by examiner

*Primary Examiner*—Gary K. Graham
(74) *Attorney, Agent, or Firm*—Young & Thompson

(57) ABSTRACT

A disassemblable toothbrush, includes a bristled portion and a handle portion, the bristled portion comprising a coupling part having at least one flexible working portion provided with a tooth and the handle portion comprising a seat for engagement of the coupling part which has at least one locating element for retaining the tooth, in which the engaging seat (4) comprises a recess (4*b*) for housing a deformable elastomeric mass (E) able to exert an elastic reaction pressing against the flexible working portion of the coupling part so as to keep the tooth (3*c*) actively engaged with the locating element (6).

8 Claims, 6 Drawing Sheets

1
2ND MATERIAL
ELASTOMER
4a
4
3
2
1ST MATERIAL
2h
2a
S

II
II

1'
4a
4'
3'
2'

IV
IV

DISASSEMBLABLE TOOTHBRUSH WITH POSITIVE BLOCKING

FIELD OF THE INVENTION

The present invention relates to a disassemblable toothbrush. In particular it relates to a toothbrush which can be disassembled into a handle portion and a replaceable bristled portion which are connected together by an improved engaging and blocking system.

1. Background of the Invention

As is known, toothbrushes with a replaceable bristled portion already exist for some time now on the market, said toothbrushes being designed with the fundamental aim of providing an oral hygiene device which has appreciable ecological, low-cost and practical characteristics.

At the present time there are many types of such disassemblable toothbrushes in which the replaceable portion assumes correspondingly different forms and dimensions coinciding, in certain cases, with the head and a neck portion of the toothbrush and, in other cases, with a much more small portion of the toothbrush.

Recently there has been a more pressing need for a toothbrush which, while being able to be disassembled easily, is also well constructed with regard to robustness in the assembled state. In fact, owing to the presence of increasingly stringent regulations, it is necessary to comply with very high safety standards aimed at preventing the possibility of the bristled portion becoming detached from the handle portion and ending up freely inside the oral cavity, with the consequent risk of being swallowed or causing injury.

2. The Known Prior Art

Examples of the prior art consist in the U.S. Pat. No. 5,253,948 in the name of Butler and the international PCT applications WO97/14329 in the name of Le Bourdonnec and WO99/23911 in the name of Vasey. The assembly and blocking system, in these cases, is based on the engagement of deformable elastic parts which are coupled together and uncoupled by means of a simple manual pushing or pulling action on the two disassemblable portions: however, since there is no active or positive system for preserving the assembly, there remains a certain risk of accidental separation of the said portions.

U.S. Pat. No. 5,875,510 in the name of Lamond et al. (on the basis of which the introductory part of the main claim is formed) and U.S. Pat. No. 4,227,276 in the name of Ginsburg at al. illustrate assembly systems in which elastic tongues, integral with the bristled portion and provided with teeth, are inserted into associated seats, being elastically deformed and engaging with their teeth in corresponding retaining openings in the handle portion. In order to be able to disassemble these toothbrushes, it is first necessary to press on the teeth beforehand so as to deform the tongues and disengage the associated teeth from the openings, and then separate the two portions of the toothbrush by means of pulling.

Engagement of the teeth in the retaining openings is maintained by the inherent elasticity of the tongues of plastic material, namely by the elastic force which the tongues are able to exert, tending naturally to return into the undeformed condition, i.e. the condition where the teeth are inserted inside the openings. This structure, however, has various drawbacks.

Firstly, the tongues are slender and have small dimensions and therefore are unable to exert a notable elastic force such as to prevent with certainty accidental disengagement of the teeth from the retaining openings.

Moreover, in view of the slender nature of the tongues, after repeated use a certain degree of yielding of the plastic material may occur, said material thus further losing its elastic retaining capacity.

Finally, since mating of the two toothbrush portions must necessarily occur with a certain degree of play, the tongues must at least consist of two facing tongues so as to exert opposing thrusting forces which ensure that at least one of the two teeth is always fully engaged in its retaining opening.

OBJECT OF THE INVENTION

U.S. Pat. No. 5,673,452 discloses a disassembleable toothbrush in which an anti-slip pad in inserted in a through hole of the toothbrush handle so as to abut against a hook portion of a blocking slender tang. Said pad shall be removed from its hole using sharp tools before being able to disassemble the toothbrush.

The Applicant, with the aim of overcoming all the problems of the prior art, has tackled the technical problem of providing a totally safe system for assembly of a disassemblable toothbrush, such as to be able to satisfy even the most demanding requirements, developing a solution which simultaneously has a simple constructional design, a low manufacturing cost and is convenient and practical to use.

This object has been perfectly achieved by means of a toothbrush, the essential features of which are described in the accompanying claims.

Further details and characteristic features of the toothbrush according to the invention will nevertheless emerge more clearly from the following description provided by way of example and illustrated in the accompanying drawings, in which:

DETAILED DESCRIPTION OF THE INVENTION

Figures 1, 2, 3, 4:
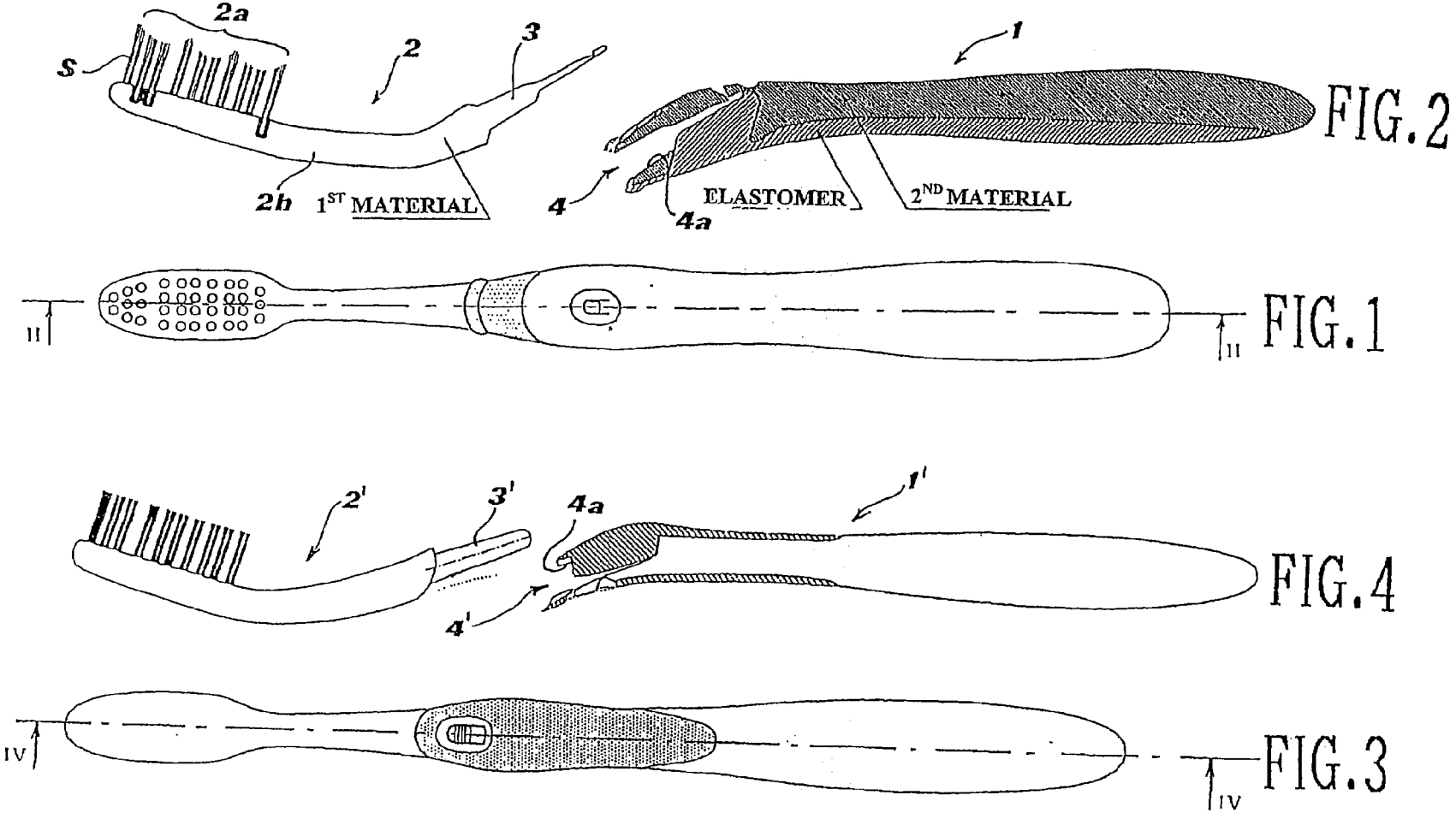
FIG. 1 is a plan view of a first embodiment of the toothbrush according to the invention.
FIG. 2 is a longitudinally sectioned view along the line II—II in FIG. 1, with the two toothbrush portions disassembled.
FIGS. 3 and 4 are views, similar to those of FIGS. 1 and 2, of a second embodiment of the invention.
Figure 8:
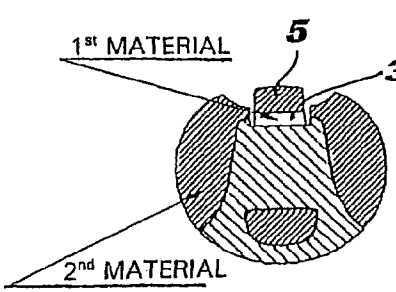
FIGS. 6, 7 and 8 are cross-sectional views along, respectively, the lines VI—VI, VII—VII and VIII—VIII in FIG. 5.

As can be seen in FIG. 2, a disassemblable toothbrush has a handle portion 1 assembled in a removable manner with a bristled portion 2.

The bristled portion 2 comprises a cleaning head 2*a*, to which tufts of bristles S are fixed, and a neck part 2*b*. A coupling part 3 extends from the end of the neck part 2*b* and is able to engage in an engaging seat 4 correspondingly provided in the handle portion 1.

According to the invention, the coupling part 3 has a substantially rigid initial body 3*a* and a more slender, substantially flexible working portion 3*b* on which a retaining tooth 3*c* is provided.

The engaging seat 4 comprises a guide mouth 4*a* which has a cross-section corresponding to that of the body 3*a* of the coupling part 3 and which terminates in a housing recess 4*b*. The recess 4*b* preferably opens outwards on at least one side of the handle portion 1.

Figure 7:
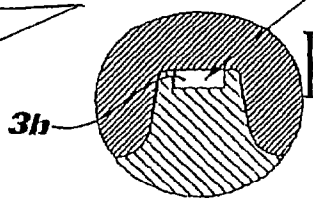
Figure 6:
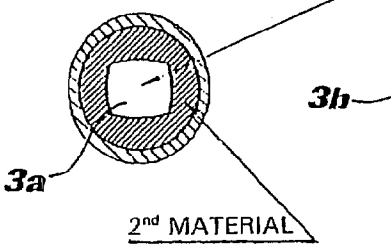
Figure 5:
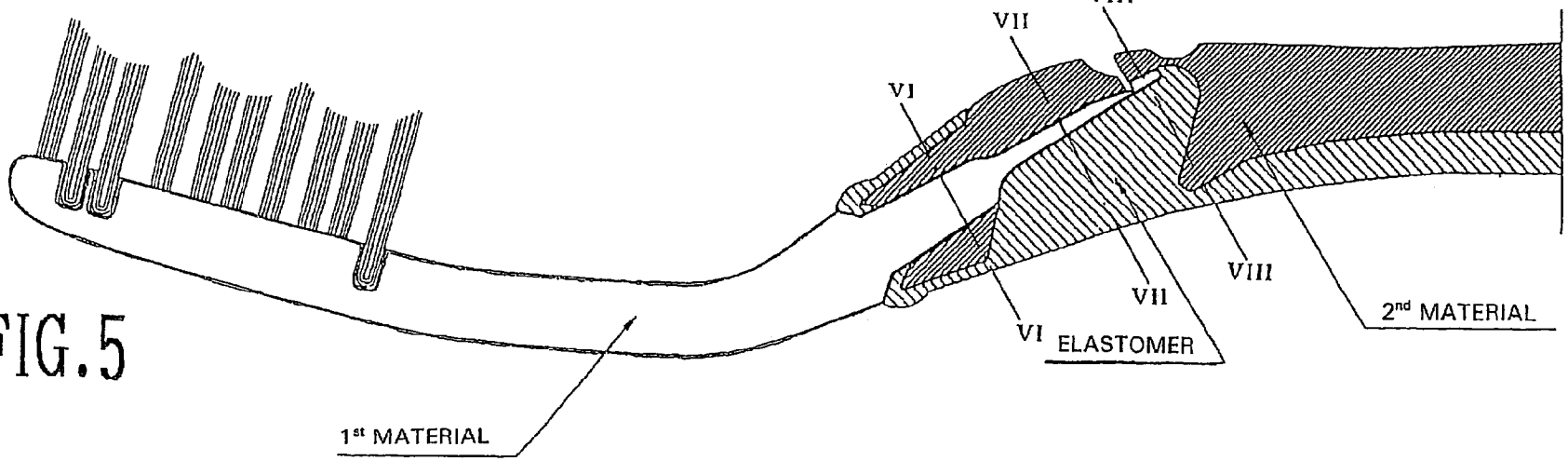
FIG. 5 is an enlarged partial view of FIG. 2 with the toothbrush assembled.

According to a first embodiment of the invention (FIGS. 5–9) the working portion 3*b* is in the form of a tongue with a substantially rectangular cross-section (FIG. 7), tapered towards the end and flexible about a fulcrum point situated in the zone of connection with the body portion 3*a*.

A tooth 3*c* is provided on the end of the tongue 3*b*.

Figure 9:
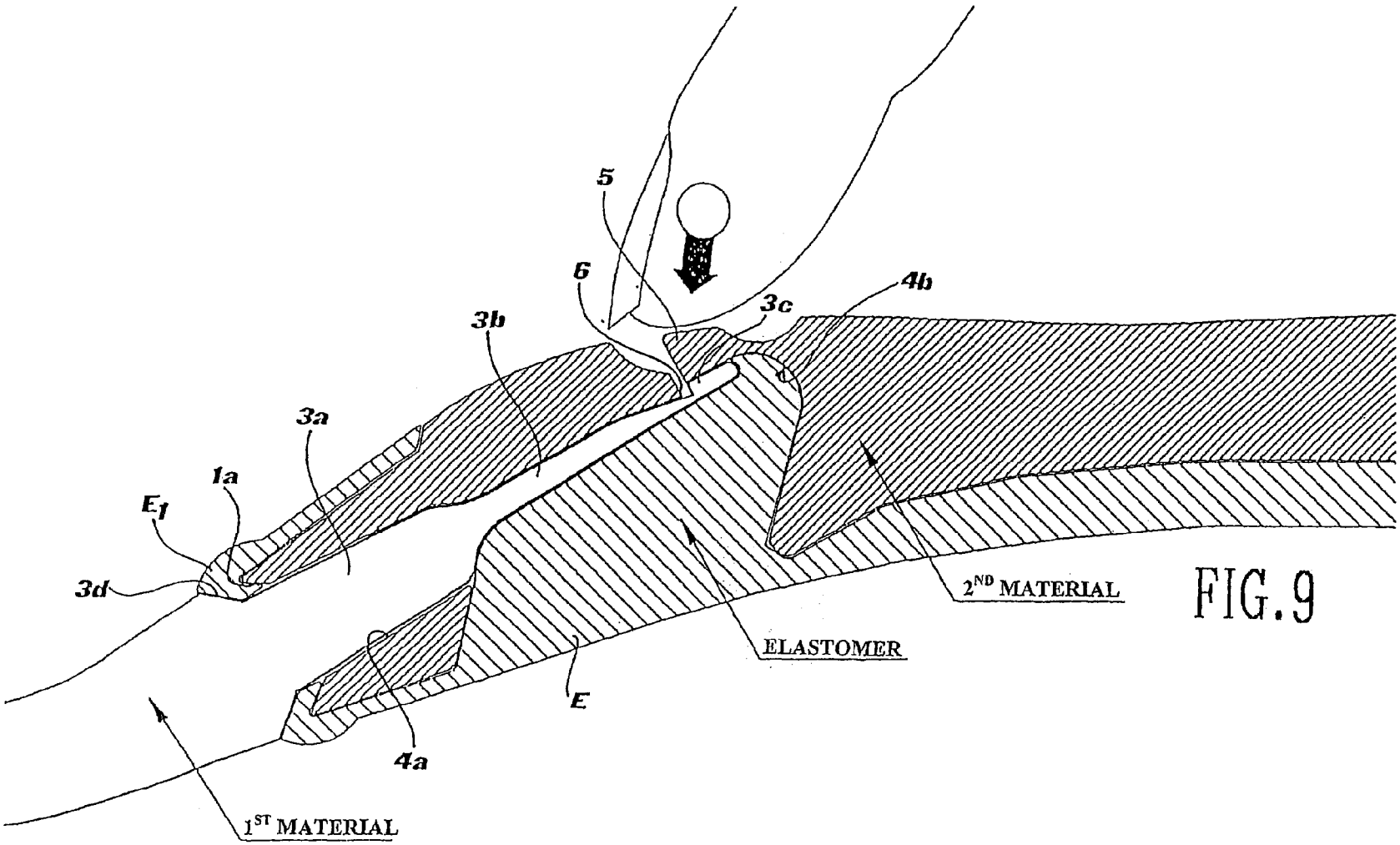
FIG. 9 is an enlarged view of FIG. 5 which illustrates operation of the toothbrush according to the invention.
Figure 11:
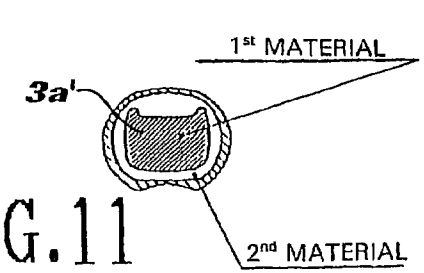
FIGS. 10–13 are views, similar to those of FIGS. 5–8, relating to a second embodiment of the invention.

According to a preferred embodiment, on the bottom of the recess 4*b* the handle portion 1 has an interruption in continuity of the wall, in the form of a flexible button 5. The flexible button 5 is able to come into contact with the tooth 3*c* so as to be able to displace it, as will be described further below. Advantageously the button 5 has sufficiently large dimensions such that it may be pressed more easily by a user's finger (FIG. 9).

Figure 12:
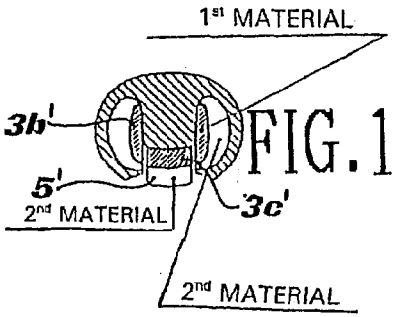
Figure 13:
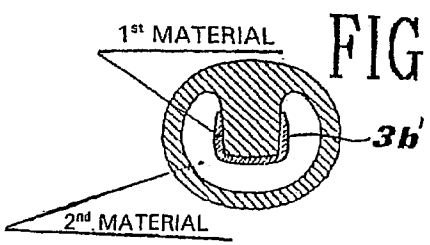
Figure 10:
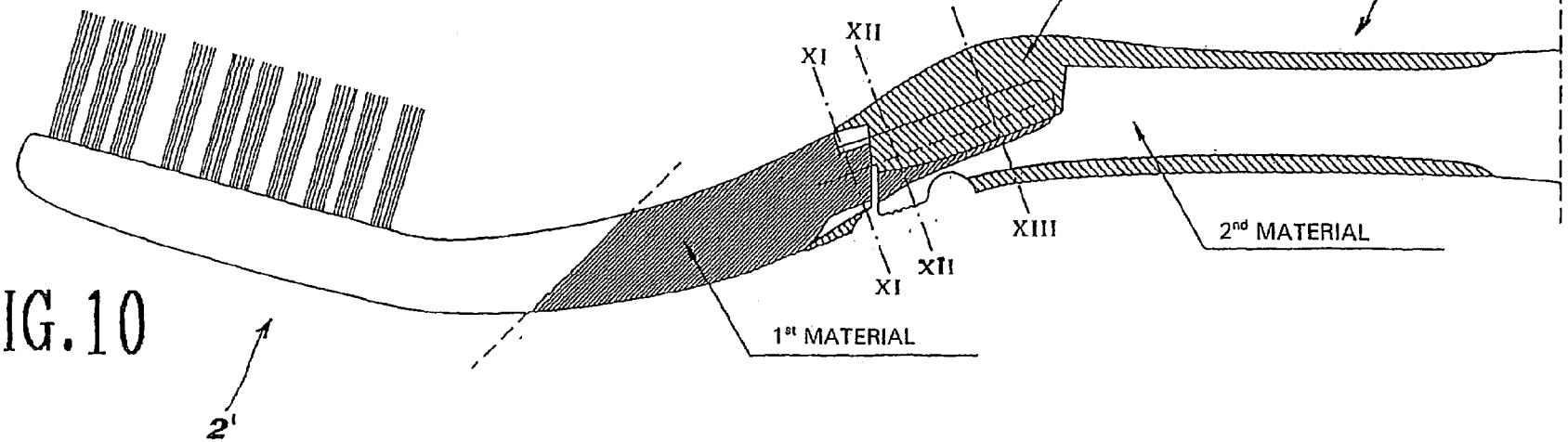
Figure 14:
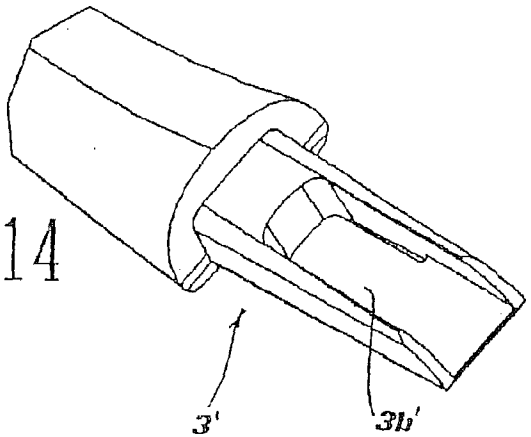
FIG. 14 is a detailed perspective view (on the scale 4:1) of the assembly system of the second embodiment.
Figure 15C:
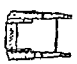
FIGS. 15A–15C are cross-sectional views along the lines 15A—15A, 15B—15B and 15C—15C in FIG. 15.
Figure 15B:
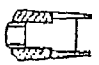
Figure 15A:
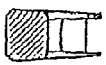
Figure 15:
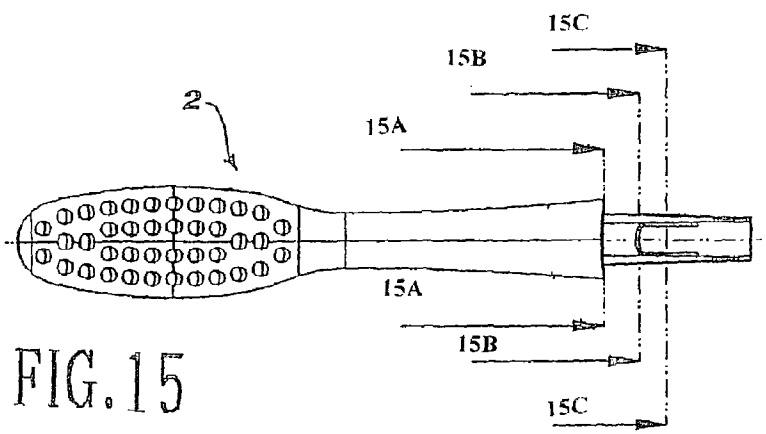
FIG. 15 is a top plan view of the bristled portion, with the tufts removed, of the second embodiment.
Figure 16:
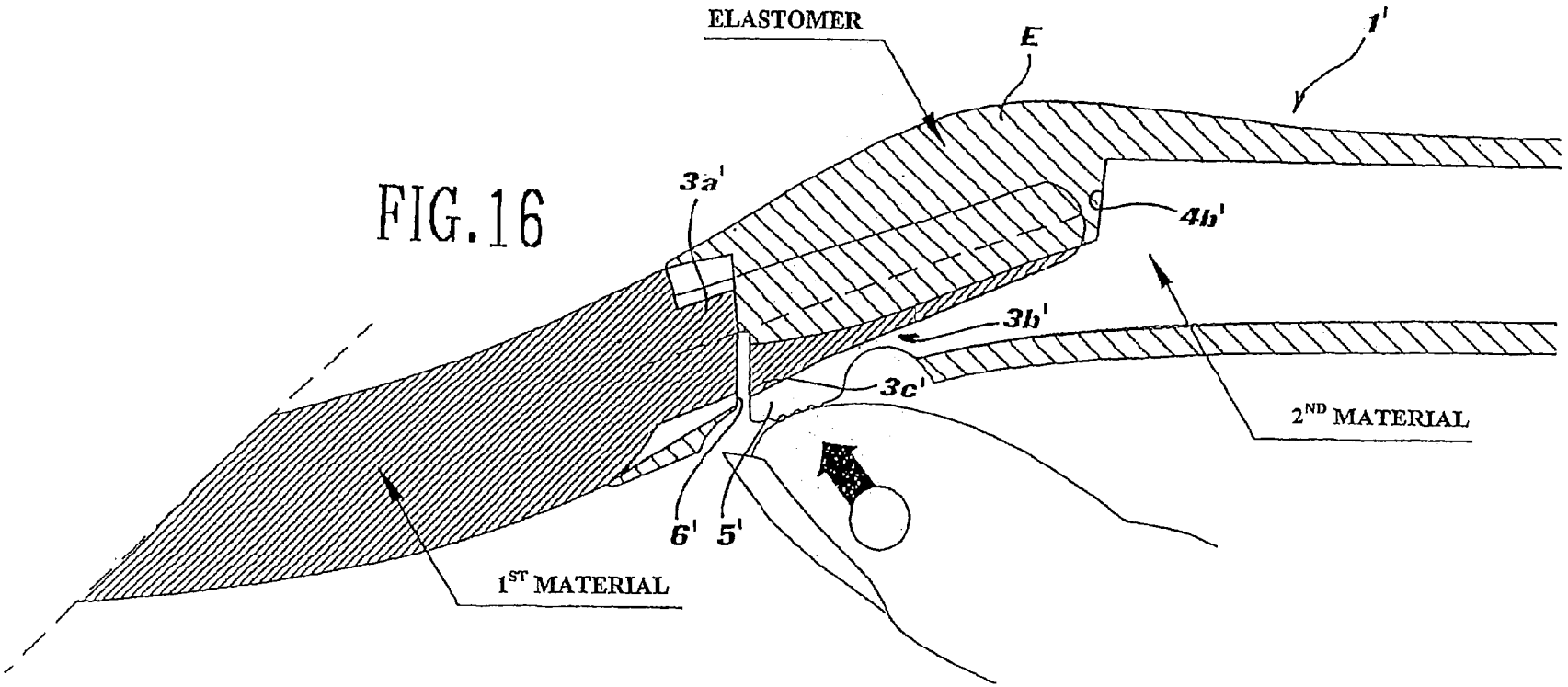
FIG. 16 is a view, similar to that of FIG. 9, relating to the second embodiment.

According to another embodiment of the invention (FIGS. 10–16), the working portion 3*b*' has a U-shaped cross-section (FIGS. 13 and 14). As can be seen in FIGS. 12, 15 and 16, the working portion 3*b*' is interrupted by a transverse incision and by two longitudinal incisions which cut out a flexible tongue portion provided with a tooth 3*c*'. In this case also, the handle portion 1' preferably has, on its wall, a flexible button 5' able to come into contact with the tooth 3*c*'.

In the working position of the toothbrush, namely when the bristled portion 2, 2' is fully engaged in the handle 1, 1', the initial body 3*a*, 3*a*' is housed and guided precisely in the guide mouth 4*a*, while the retaining tooth 3*c*, 3*c*' is positioned in correspondence of a shoulder or locating portion 6, 6' provided inside the recess 4*b*, 4*b*' and integral with the handle. In this condition, the initial body retains the coupling part in its seat against the lateral forces applied to the head 2*a* and the tooth, being engaged with the locating portion 6, 6', but prevents any longitudinal sliding of the coupling part inside its seat.

According to the invention, moreover, the recess 4*b* is filled with a mass of elastomeric material E, for example introduced therein by means of a known multi-component injection process, through the opened side of the handle.

The elastomeric mass E occupies a volume inside the recess 4*b* and is deformed when also the coupling part 3 is inserted into the seat. The deformation of the mass E induces an elastic reaction of the elastomeric material which presses against the working portion of the coupling part in a direction such as to keep the tooth 3*c*, 3*c*' actively engaged with the retaining portion 6, 6', with an action which is more efficient and longer-lasting than the ordinary natural elastic return of the flexible section of the coupling part 3.

Preferably, a thin layer $E_1$ of elastomeric material is also provided at the end of the handle portion 1, in the region of a contact surface 1*a* thereof. This layer $E_1$ is compressed, in the assembled state of the toothbrush, between the contact surface 1*a* and a corresponding stop surface 3*d* of the coupling part 3: the elastic reaction which is produced helps makes the assembly more stable, taking up part of the play which may be created.

As can be easily understood, assembly of the toothbrush occurs by means of insertion of the coupling part 3, 3' inside its own seat 4, 4', with a slight pressure able to bring the tooth 3*c* and 3*c*' beyond the locating surface 6 and 6'. When, however, the flexible button 5 and 5' is pressed (FIGS. 9 and 14), the tooth 3*c* and 3*c*' is also pressed, causing flexing of the working portion 3*b*, 3*b*'. In this way, the tooth is lowered sufficiently such that it may be disengaged from the locating surface 6, 6' and thus allow the extraction of the bristled portion 2, 2' from the handle.

The extreme simplicity and rational nature of the solution proposed also mean that the entire toothbrush may be obtained by means of successive injection-moulding operations, without having to mould the various components separately and then assemble them later.

In particular, advantageously, the handle 1 and the bristled portion 2 are made of materials which are physically and/or chemically unrelated or incompatible, namely are such that they do not tend to bond with each other when they are moulded together or in succession one over another: as a result it is possible to use a co-moulding technique already also illustrated in European patent application No. EP-A1-1075806 in the name of the same Applicant, on the basis of which the seat 4 of the handle itself acts as a moulding die for the coupling part 3 (or vice versa).

Alternatively, should the two materials be too closely related, a thin layer of a separating substance may be provided in between such as to prevent the two components from becoming bonded together. Other techniques may be used to prevent the two materials being bonded together if moulded in succession one over another.

In this way, on the one hand, it is possible to achieve a saving in the cost and simplification of the manufacturing process (the production machinery is correspondingly simpler and it is not required to recover and reassemble various parts during construction) and, on the other hand, excellent coupling tolerances are obtained, thereby ensuring efficient and reliable assembly of the two portions of the toothbrush.

With the toothbrush according to the invention the objects expressed in the introductory paragraphs have therefore been achieved.

In fact, the structure of the two portions which may be assembled is extremely simple, the handle being provided with a seat which can be easily moulded and the coupling part consisting of a single flexible working portion, it not being necessary to provide opposing elastic actions in order to eliminate any coupling play.

The structural simplicity, together with the original combination of materials which are unrelated or rendered incompatible, thereby making a co-moulding process possible, help achieve a general reduction in the production costs.

Moreover, the elastomeric mass, by exerting a significant elastic reaction, makes the assembly system extremely safe against accidental disassembly and takes up any play which would otherwise occur during use.

The excellent behaviour of the elastomeric material in response to repeated deformations (which certainly never reaches the yield point under the normal stress conditions to which it is exposed) does not give rise to any functional problems, even following numerous assembly and disassembly operations.

Finally, owing to the flexible button on the wall of the handle, which is not subject to dimensional or constructional restraints, it is possible to act easily on the underlying engaging tooth.

It is understood, however, that the protective scope of the invention described above is not limited to the particular embodiments illustrated, but extends to any other constructional variant which adopts the same teachings.

For example, it is undoubtedly obvious to a person skilled in the art that the straight configuration of the coupling part 3 is certainly not the only one compatible with the technical result which is to be achieved; in fact, similar operation is obtained provided that the coupling part has a configuration which allows easy extraction thereof from the handle, for example if the coupling part is formed in the manner of an arch of a circle with constant radius.

What is claimed is:

1. Disassemblable toothbrush, comprising a bristled portion (2, 2') and a handle portion (1, 1'), said bristled portion (2, 2') comprising a coupling part (3, 3') having at least one flexible working portion (3*b*, 3*b*') provided with a tooth (3*c*, 3*c*') and said handle portion comprising a seat for engagement of said coupling part which has at least one locating element (6, 6') for retaining said tooth, characterized in that said engaging seat comprises a recess (4*b*, 4*b*') filled with deformable elastomeric mass (E) being compressed by the insertion of said working portion and able to exert an elastic reaction pressing against said flexible working portion (3*b*, 3*b*') of the coupling part so as to keep said tooth (3*c*, 3*c*') actively engaged with said locating element (6, 6'), and wherein said handle portion has a flexible button (5, 5') in correspondence of said tooth (3*c*, 3*c*'), having dimensions such that it may be easily pressed by a user's finger and able to act on said tooth (3*c*, 3*c*') so as to disengage it from said locating element.

2. Toothbrush according to claim 1, in which said recess opens outwards on one side of the handle portion.

3. Toothbrush according to claim 2, in which said elastomeric mass (E) is permanently formed inside said recess (4*b*) by an injection process.

4. Toothbrush according to claim 1, in which said flexible button (5, 5') is formed as one piece with said handle.

5. Toothbrush according to claim 1, in which said coupling part has a U-shaped profiled portion.

6. Toothbrush according to claim 5, in which said U-shaped profiled portion is interrupted centrally by a transverse incision and by two longitudinal incisions so as to form said flexible working portion.

7. Toothbrush according to claim 1, in which said bristled portion and said handle are made of materials which are unrelated or rendered incompatible, such that they do not bond with each other during a co-moulding process.

8. Toothbrush according to claim 1, in which at least one further cushion of elastomeric material is arranged between said bristled portion and said handle and is able to produce an elastic reaction in the direction of assembly of the toothbrush.

* * * * *